US005251425A

United States Patent [19]

Kern

[11] Patent Number: 5,251,425

[45] Date of Patent: Oct. 12, 1993

[54] ENVELOPING DEVICE

[75] Inventor: Peter Kern, Oberdiessbach, Switzerland

[73] Assignee: Kern AG, Konolfingen, Switzerland

[21] Appl. No.: 851,009

[22] Filed: Mar. 11, 1992

[30] Foreign Application Priority Data

Mar. 12, 1991 [CH] Switzerland ..... 747/91

[51] Int. Cl.[5] ..... B65B 43/39

[52] U.S. Cl. ..... 53/460; 53/381.7; 53/569

[58] Field of Search ..... 53/259, 284.3, 381.5, 53/381.7, 460, 492, 571, 569

[56] References Cited

U.S. PATENT DOCUMENTS

| | | | |
|---|---|---|---|
| Re. 24,459 | 4/1958 | Kern | 53/569 |
| 1,543,842 | 6/1925 | Gwinn et al. . | |
| 1,668,761 | 5/1928 | Coty et al. . | |
| 2,915,863 | 12/1959 | Kummer . | |
| 3,253,384 | 5/1966 | Huck et al. | 53/284.3 X |
| 3,423,900 | 1/1969 | Orsinger . | |
| 3,872,649 | 3/1975 | Wimmer | 53/284.3 X |
| 4,649,691 | 3/1987 | Buckholz | 53/284.3 X |

FOREIGN PATENT DOCUMENTS

| | | |
|---|---|---|
| 2913428A1 | 10/1980 | Fed. Rep. of Germany . |
| 1145654 | 10/1957 | France . |

*Primary Examiner*—John Sipos
*Assistant Examiner*—Linda B. Johnson
*Attorney, Agent, or Firm*—Jacobson, Price, Holman & Stern

[57] ABSTRACT

A device for feeding and stuffing envelopes opens the flap (2) of the bottom envelope (3) of a stack (1) with a rotating opener claw (5, 6, 7 ). As soon as the flap is sufficiently open, it is seized by two rotating transport elements (8, 9) and pressed against two conveyor rollers (10, 11). The opener claws (5, 6, 7) and the conveyor elements (8, 9) are disposed on the same shaft (4), but are supported and driven independently of each other. The opener claws are only operated from a coupling (12) when a packing operation is to be carried out. The conveyor elements (8, 9) and the conveyor rollers (10, 11) run continuously. Two pairs of conveyor rollers (17, 18, 19, 20) convey the envelope towards a packing trap (13). As soon as the flap (2) of the envelope (3) is positioned below a hold down roller (21), the latter begins to descend. Simultaneously, the packing trap (13) begins to pivot towards the envelope and the envelope (3) is drawn onto the packing trap (13). The prepared contents (38) of the envelope are conveyed by transport fingers (34) into the packing trap (13) from the opposite side. Transport fingers (34) push the envelope (3) and contents (38) from the packing trap between conveyor belts (43, 44) and out of the enveloping unit.

20 Claims, 8 Drawing Sheets

ENVELOPING DEVICE

BACKGROUND OF THE INVENTION

This invention concerns an enveloping device with a container for empty envelopes, and a process for operating this enveloping device.

In prior art enveloping machines the envelope is withdrawn from a stack, brought into position, opened and the content is then inserted, leading to a pause which delays the packing rate. In this prior art machine, various elements carry out to and fro movements and this restricts the packing rate of this prior art enveloping machine.

BRIEF SUMMARY OF THE INVENTION

It is an object of this invention to avoid the disadvantages of the state of the art and to provide an enveloping device with which the packing rate can be approximately doubled. This is achieved according to the invention by the features described in this application. A further object is to design the enveloping machine in such a way that even at high packing rates, the envelopes can be suitably deformed to some degree, i.e. opened, whilst they are being conveyed from the envelope stack to the packing trap and before they reach the latter, so that the envelopes can be reliably maneuvered onto the packing trap. This is achieved by means of a holding down roller disposed in the area above the end of the packing trap closest to the envelope container.

BRIEF DESCRIPTION OF THE DRAWINGS

An example of an embodiment of the invention will be described below in more detail with reference to the accompanying drawings, wherein.

DETAILED DESCRIPTION

Figure 1:
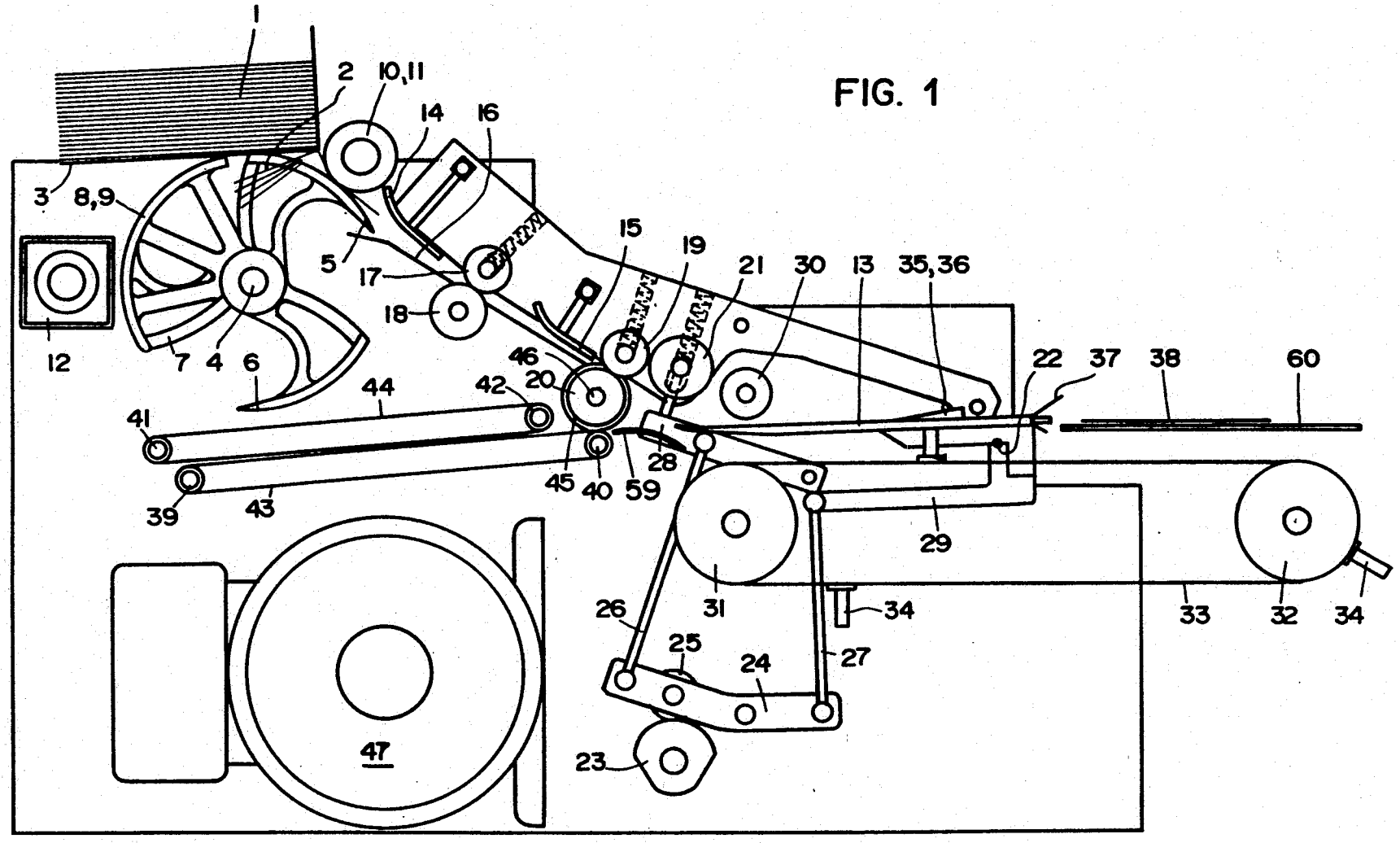
FIG. 1 is a side schematic elevational view of the enveloping device of this invention.

The basic construction and the operating sequence of the process of the enveloping device for an enveloping machine will be described with reference to FIG. 1. The enveloping device or unit forms the central part of an enveloping machine. Pre-treatment of the contents of the envelope, i.e. of the sheets of paper, or rolls or stacks of pre-printed forms, brochures etc., in the form of cutting, grouping, folding etc., and, likewise, post-treatment of the packed envelopes in the form of closing, sealing, franking, bundling etc., do not take place within the scope of the enveloping device described here.

From a vertical stack 1 of empty, unsealed envelopes arranged with their bent-over flap downwards, the flap 2 of the bottom envelope 3 is opened with one of three opener claws 5, 6 or 7 disposed on a shaft 4. As soon as the flap 2 is sufficiently open, it is seized by two conveyor elements 8, 9 and pressed against two conveyor rollers 10, 11 The conveyor elements 8, 9 and the conveyor rollers 10, 11 have the same peripheral speed. The opener claws 5, 6 and 7 and the conveyor elements 8 and 9 are disposed on the same shaft 4, but are supported and driven independently of each other. In order to prevent the opener claws 5, 6 and 7 from damaging the envelope at high processing speeds, i.e. by perforating the flap, the opener claws 5, 6 and 7 rotate in a whole number ratio slower than conveyor elements 8 and 9. Opener claws 5, 6 and 7 are disposed at regular intervals on the periphery. The number of opener claws and therefore the rotation ratio of opener claws and conveyor elements is dependent on the envelopes used. The opener claws are only operated from a coupling 12 when a packing operation is to be carried out. The conveyor elements 8, 9 and the conveyor rollers 10, 11 run continuously.

While the opened envelope is conveyed onwards towards a packing trap 13, hold down elements 14 and 15 ensure that the envelope is fed along a guide plate 16. Two further pairs of transport rollers 17, 18 and 19, 20 ensure that the envelope is reliably conveyed. As soon as the envelope has been conveyed so far that its flap is positioned under a hold down roller 21, the latter begins to descend. Simultaneously, the packing trap 13 begins to pivot around a point of rotation 22 towards the envelope. The linear movement of the hold down roller 21 and the pivotal movement of the packing trap 13 are controlled by a cam 23 and the motion thereof is transferred to the hold down roller and the packing trap by means of a cam follower 25 and a system of levers 24, 26, 27, 28, 29. As soon as the packing trap has reached the uppermost position and the envelope opening has been drawn over the trap, conveyor rollers 30 begin to convey the envelope into the final position on the packing trap 13 (see also FIG. 5). As soon as this position has been reached, the packing trap 13 pivots downwards and the holding down roller 21 is pushed upwards. While the envelope is being pushed onto the packing trap 13, from the opposite side, conveyed by transport fingers 34 affixed to a toothed belt 33 guided over rollers 31 and 32, the prepared content 38 of the envelope is conveyed into the packing trap on a feed plate 60 (see also FIG. 6). On the upper side of the packing trap there are projections 35 and 36, so that the transport fingers 34 do not get blocked by the envelope flap 2. The end 37 of the packing trap closest to the envelope contents brought up to it is funnel-shaped. The transport fingers 34 serve to push the contents 38 together with the envelope 3 to conveyor belts 43 and 44 guided on rollers 39, 40, 41 and 42. The conveyor belts 43 and 44 convey the envelope and its contents to another processing point of the enveloping machine (see also FIG. 7). There is never any pause in the movement of the contents 38 of the envelope; they are pushed at a constant rate through the packing trap 13 into the envelope 3 and, together with the latter, between the conveyor belts 43 and 44. As soon as the envelope 3 has reached the conveyor rollers 45 it is gripped between the latter and the lower conveyor belt 43 and transported by the conveyor belts 43 and 44 out of the enveloping unit, where it may be finished for dispatch by other units. The conveyor rollers 20 are non-rotatably connected with the toothed belt driven shaft 46, and the conveyor rollers 45 are supported on the same shaft with ball bearings. The next envelope is withdrawn from stack 1 at the moment when the previous packed envelope begins to be drawn off from packing trap 13. The flaps of the two envelopes cross each other in the area beneath hold down roller 21. The entire enveloping unit is driven by a motor 47 which can be continuously adjusted by a frequency converter. All the moveable parts of the unit are driven by this motor, thus ensuring that all movements are synchronous to each other, this being necessary for disruption-free operation.

Figure 2:
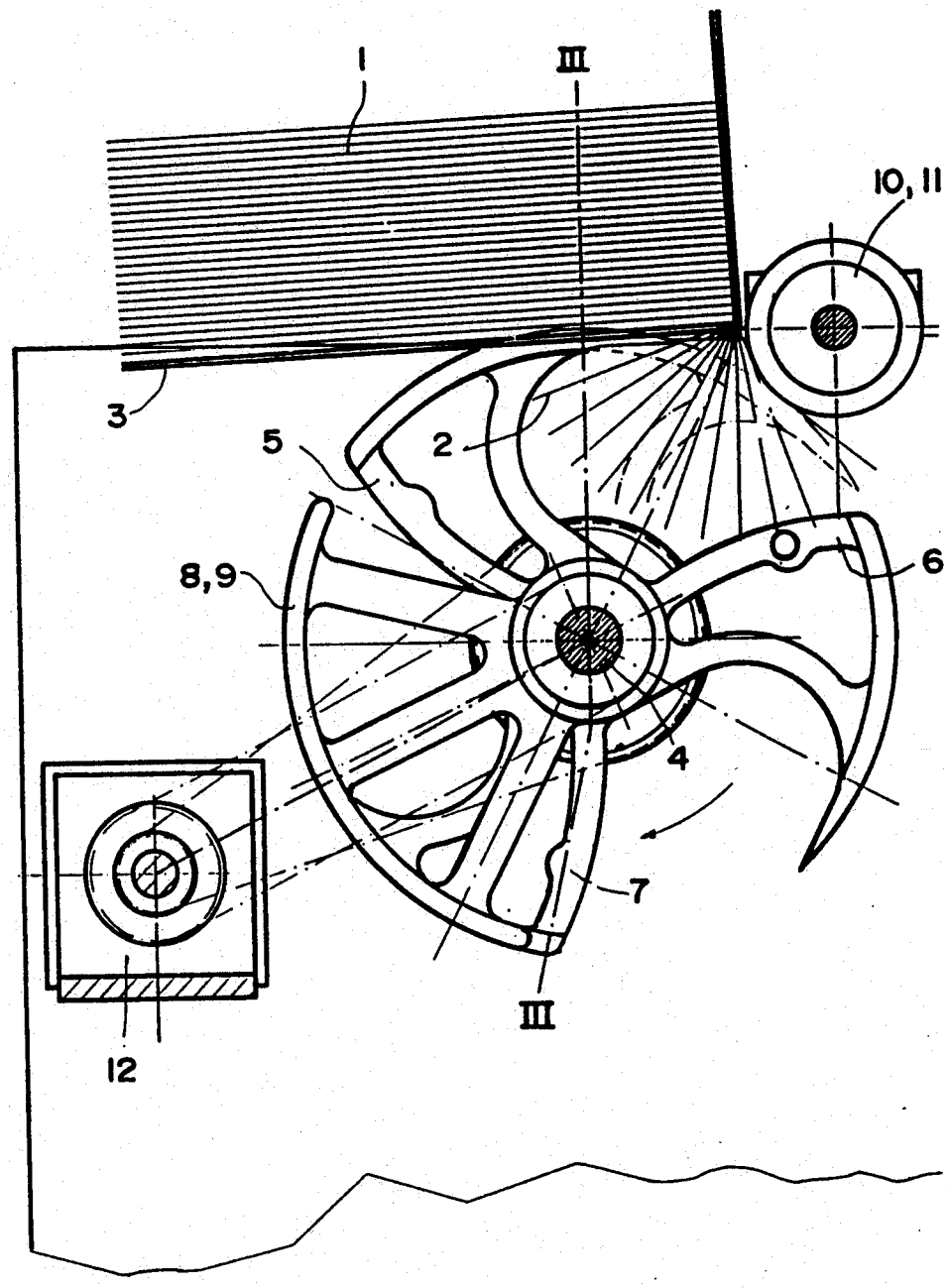
FIG. 2 is an enlarged schematic side elevational view of the drive for the opener claw of the device of FIG. 1.

FIG. 2 shows a side view of the drive for the opener claws 5, 6 and 7.

Figure 3:
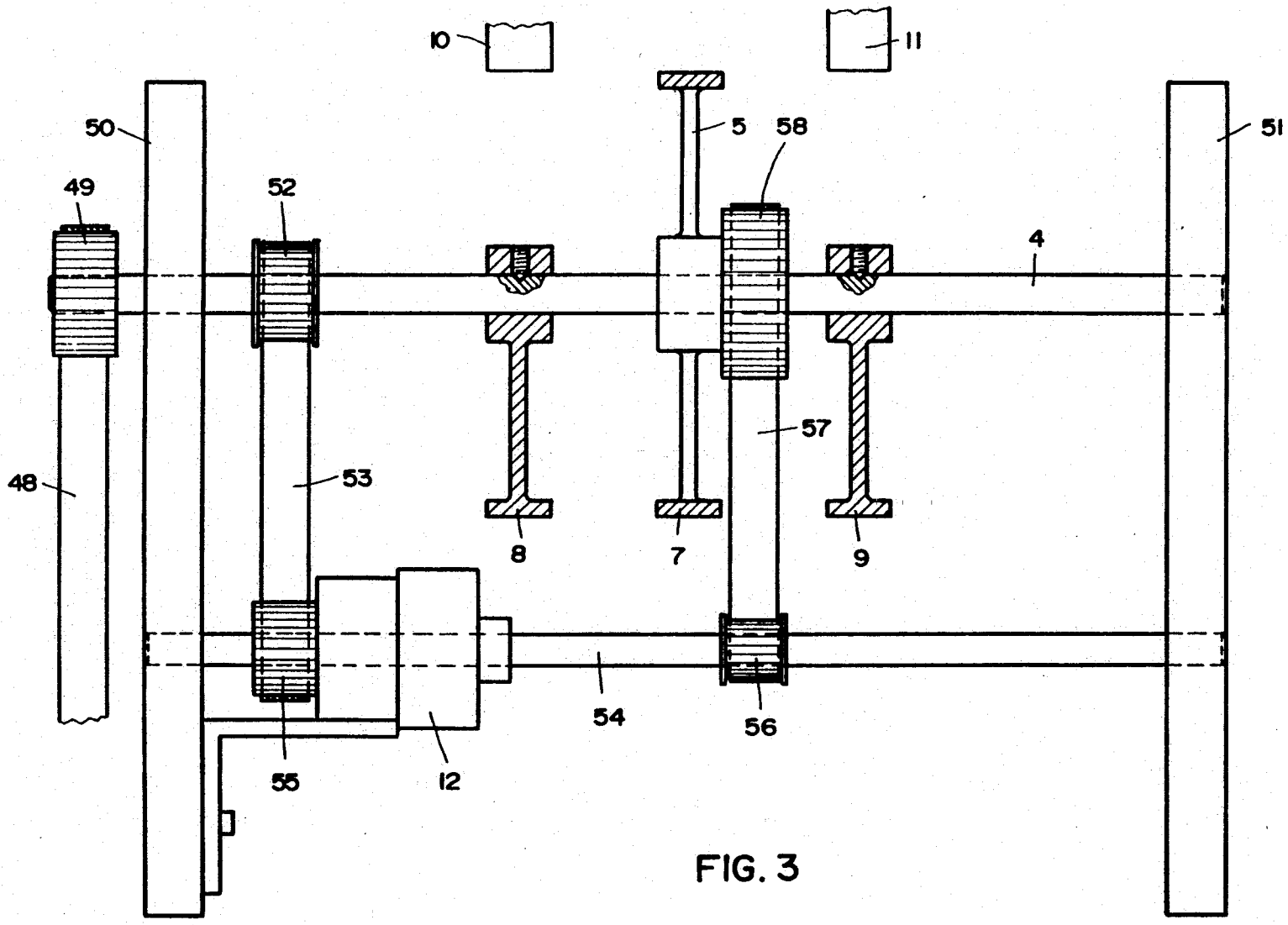
FIG. 3 is a schematic cross-sectional view taken along the line III—III of FIG. 2.

FIG. 3 shows a section along line III—III of FIG. 2. The drive from motor 47 is transferred via a toothed belt 48 to a toothed wheel 49 which is non-rotatably connected with the shaft 4. Shaft 4 is supported and held axially in side plates 50 and 51. The conveyor elements 8 and 9 are non-rotatably connected with shaft 4. Via a further toothed wheel 52 which is non-rotatably connected with shaft 4, a toothed belt 53 and a toothed wheel 55 non-rotatably connected with a second shaft 54, the drive for the opener claws 5, 6 and 7 is brought about via a coupling 12. A toothed wheel 56 is non-rotatably connected with shaft 54 and drives another toothed wheel 58 connected with the opener claws 5, 6 and 7, via a toothed belt 57. The toothed wheel 58 and the opener claws 5, 6 and 7 are rotatably supported on shaft 4 with ball bearings. Toothed wheels 56 and 58 form a stepdown gearing, so that the opener claws rotate slower than the conveyor elements 8 and 9. Shaft 54 is also supported and axially held in the side plates 50 and 51.

Figure 4:
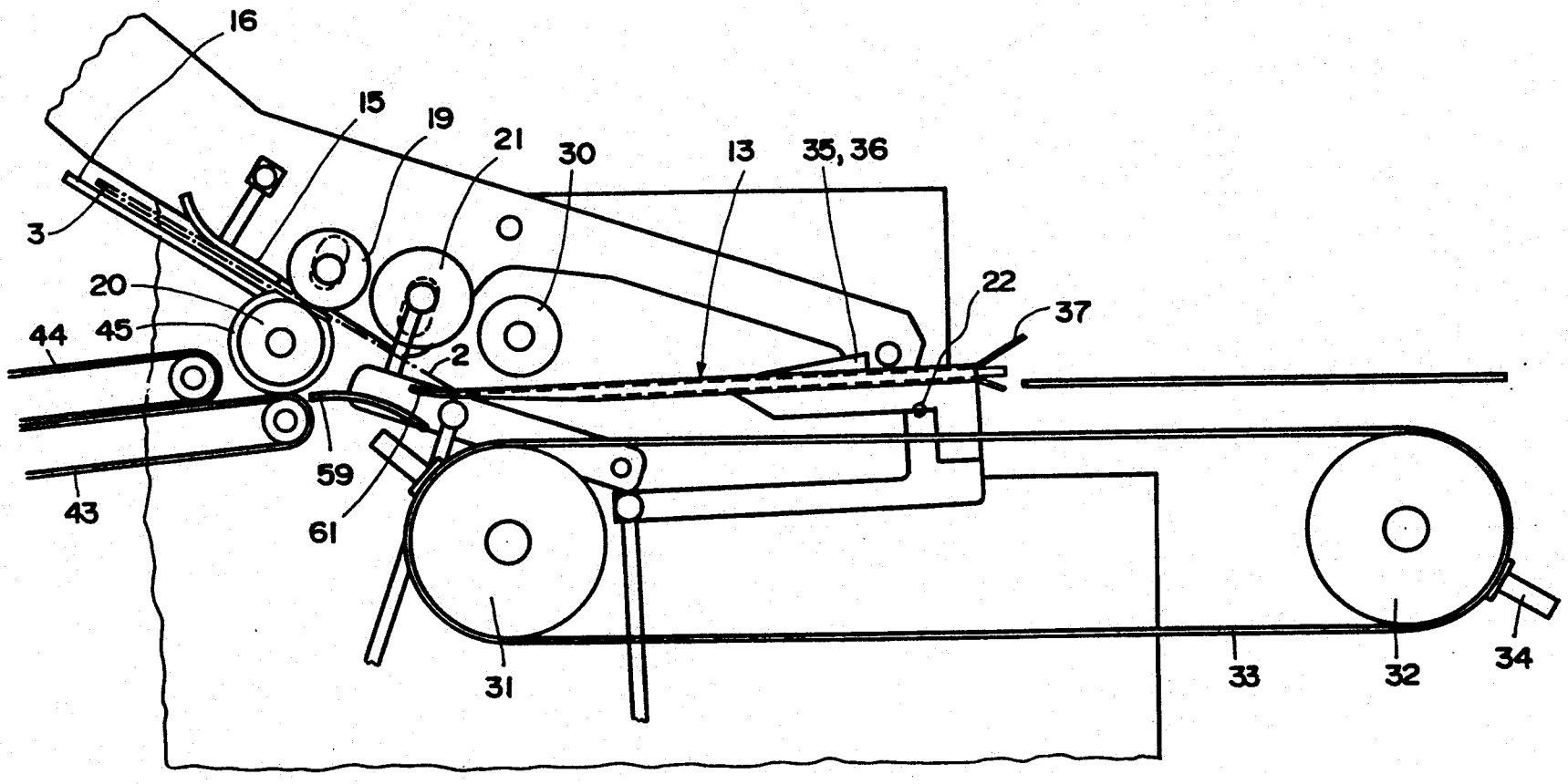
FIG. 4 is an enlarged view of a part of FIG. 1 showing the transport of an envelope in the direction of the packing trap.

FIG. 4 is a schematic of the enveloping device, in particular the area of the packing trap. The position of the envelope 3 is as shown in FIG. 4 with its flap below the hold down roller 21. The end of the flap abuts the front portion 61 of the packing trap 13.

Figure 5:
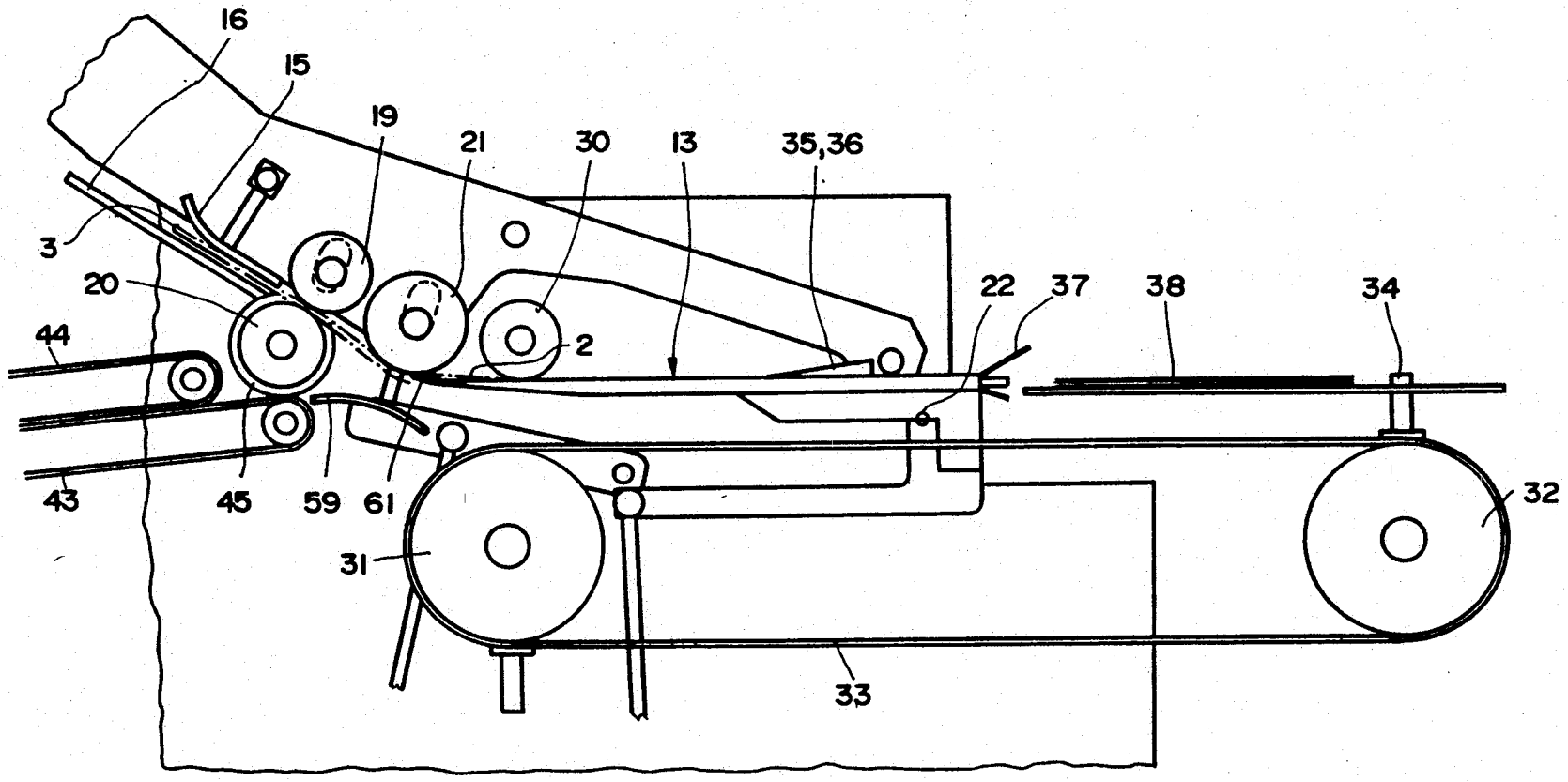
FIG. 5 is a view similar to FIG. 4 which shows how an envelope is drawn onto the packing trap.

FIG. 5 shows the same section of the enveloping device as in FIG. 4. The hold down roller 21 has descended and the packing trap 13 has been pivoted around its point of rotation 22 and upwards with its front portion 61 towards the hold down roller 21. The envelope is thereby deformed and opened and can be pushed over the packing trap 13. The conveyor rollers 30 convey the envelope into its final position on the packing trap 13.

Figure 6:
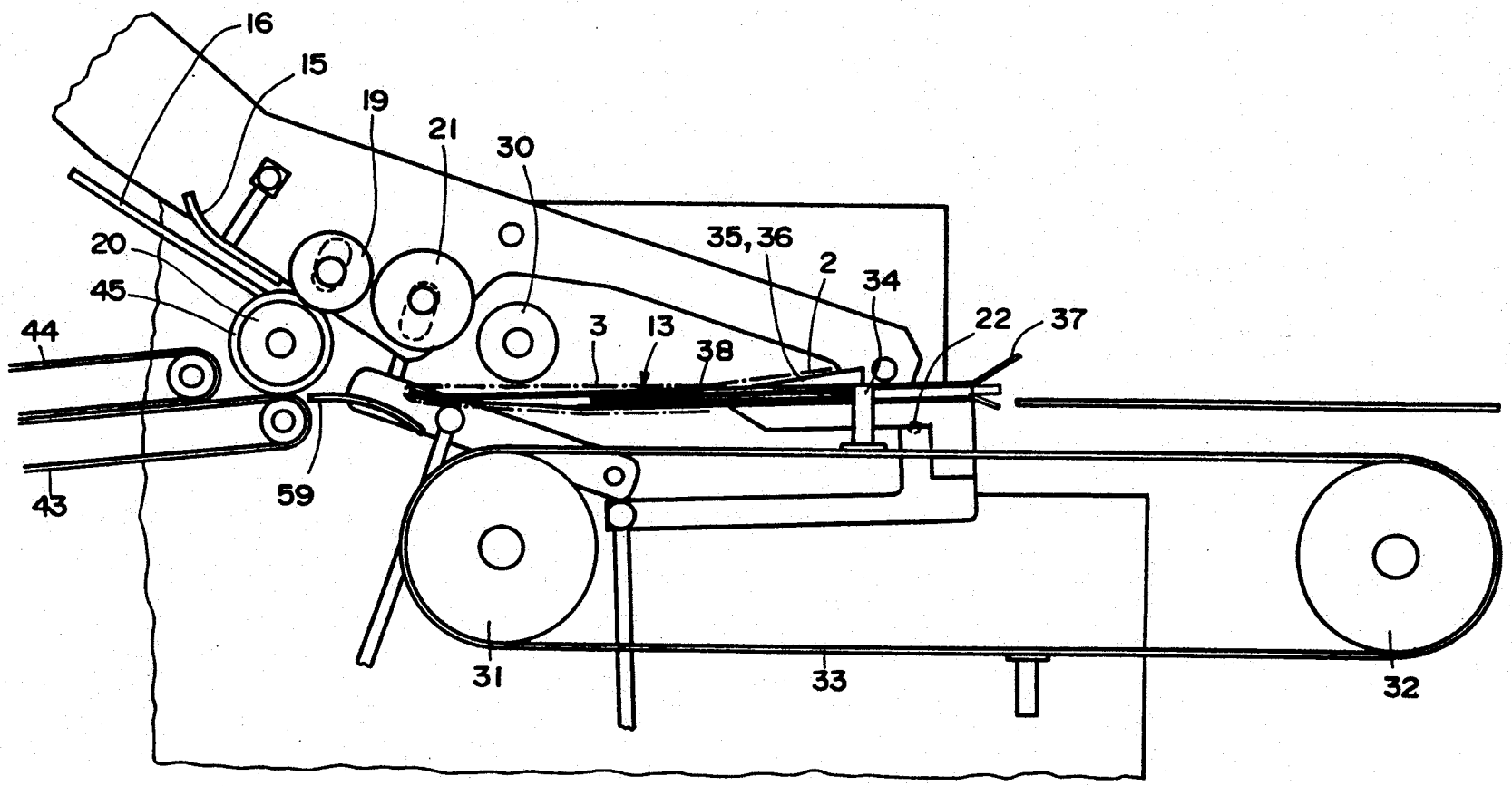
FIG. 6 is a view similar to FIG. 4 which shows how the envelope content is inserted into the packing trap.

FIG. 6 shows the same part of the enveloping device as FIGS. 4 and 5. In FIG. 6, the envelope is shown in its final position on the packing trap 13. The packing trap is pivoted downwards around the point of rotation 22 and the hold down roller 21 is pushed upwards. While the envelope is pushed onto the packing trap, the contents 38 of the envelope are conveyed by the transport fingers 34 into the packing trap. Two parallel toothed belts 33 with transport fingers 34 attached thereto are provided.

Figure 7:
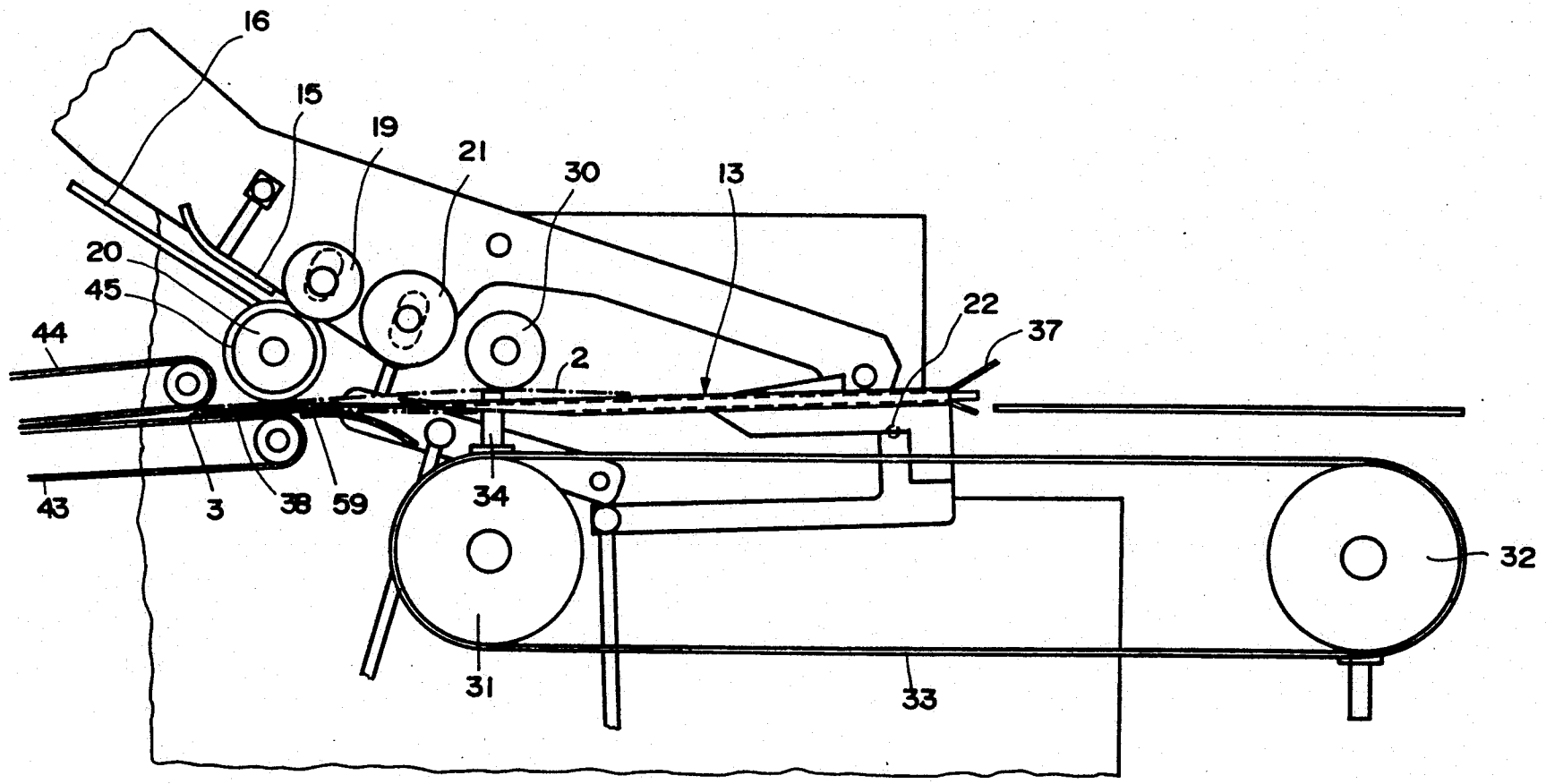
FIG. 7 is a view similar to FIG. 4 which shows how the packed envelope is removed.

FIG. 7 shows the same part of the packing device as FIG. 6. The contents 38 are pushed out of the packing trap by the transport fingers 34 together with the envelope. The envelope is conveyed over a transfer plate 59 by the conveyor rollers 45 to the conveyor belts 43 and 44 and is then transported out of the enveloping unit, where the envelope is finished for dispatch by other units.

Figure 8:
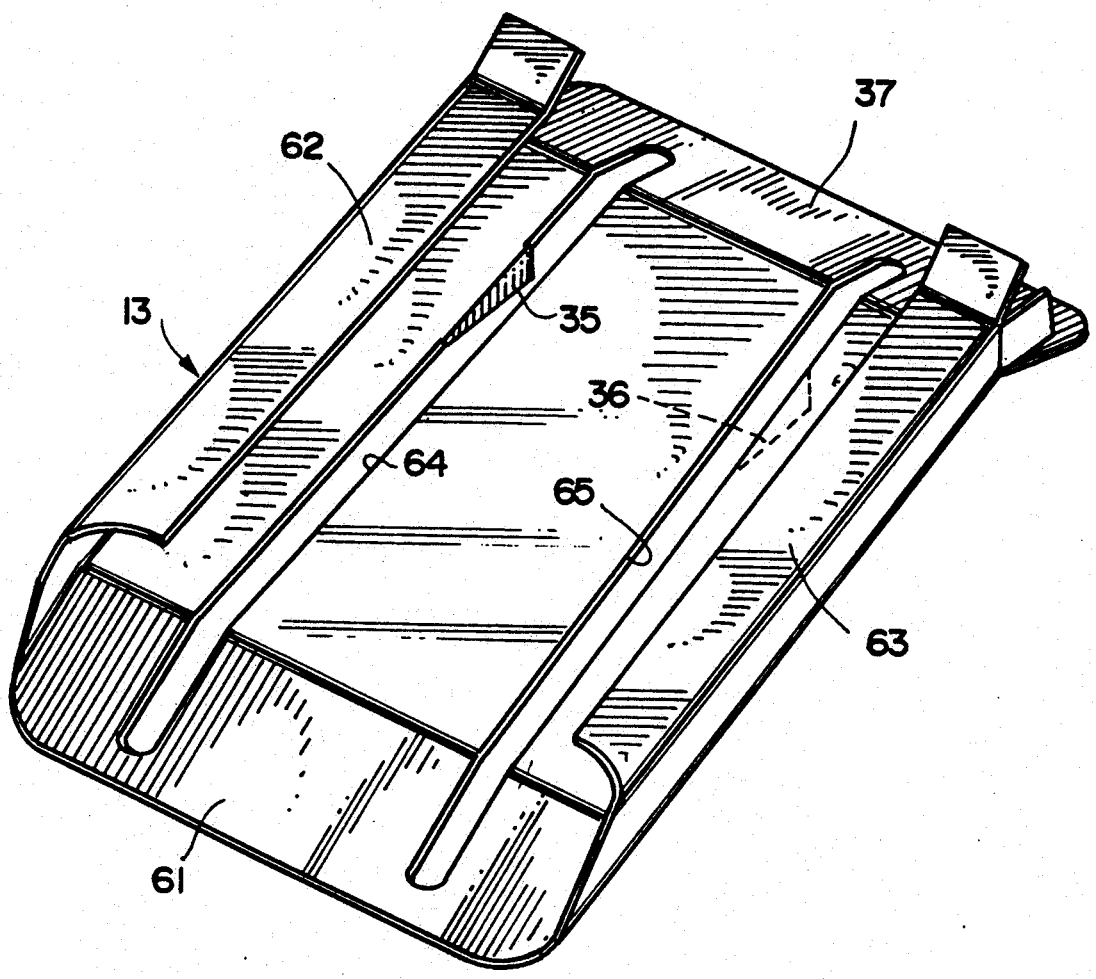
FIG. 8 is a perspective view of the packing trap.

FIG. 8 shows a perspective view from below of the packing trap. It has two bent over edges 62 and 63, between which the contents are pushed. The end 61 of the packing trap closest to the stack of envelopes is also bent. The opposite end 37 is funnel-shaped for optimal reception of the contents of the envelope. Two slots 64 and 65 are provided, through which the transport fingers 34 can protrude. The projections 35 and 36 serve to lift slightly the envelope pushed over the flap so that the transport fingers do not get blocked by the flap.

The enveloping device has only very few translationally moving or oscillating parts in order to keep at a minimum the thereby occurring forces of inertia. With the exception of the hold down roller 21, the packing trap 13 and the lever system acting on the latter, only rotational movements occur. In the holding down roller and the packing trap only small displacements or pivot angles occur.

The enveloping device according to the invention permits up to 26,000 packing operations per hour, which corresponds to a doubling of the capacity of the prior art enveloping machines.

I claim:

1. An enveloping device comprising:

envelope support means for supporting an upwardly extending stack of envelopes, each envelope having a first and second panel defining an open end, with a flap connected to said second panel on the open end and folded onto the bottom side of the envelope so that the bottom envelope in said stack can be individually stripped therefrom;

at least one flap opening element supported for rotation below and contiguous to said stack of envelopes and engageable with the flap on said bottom envelope for displacing said flap on said bottom envelope a predetermined amount outwardly from said bottom envelope into substantially the plane of said second panel when said at least one flap opening element is rotated;

a packing trap disposed in spaced relation to said support means and having a front end, a rear end, and a shape for opening said open end of said envelope when said envelope is at least partially received thereon from said front end;

a plurality of first rotatable conveyor elements comprising means rotatably mounted on an axis with said flap opening element and proximate said stack of envelopes for receiving said flap on said bottom envelope when displaced said predetermined amount and stripping said bottom envelope from said stack and conveying said stripped envelope in an initial path toward and at least partially onto said packing trap from the front end of said packing trap while maintaining said second panel in the same orientation relative to said first panel and said stack so that said open end of said envelope is opened sufficiently to receive contents therein;

means for pivotally mounting said packing trap for pivotal movement between an envelope receiving position wherein said front end of said packing trap receives thereon said stripped envelope at the open end thereof when said stripped envelope is travelling in said initial path and an envelope discharging position wherein said front end of said packing trap is displaced from said envelope receiving position in said initial path for discharging said stripped envelope from said front end of said packing trap;

contents supporting means adjacent said rear end of said packing trap for supporting contents to be inserted in said opened envelope when positioned on said packing trap;

a contents feeding conveyor engageable with said contents for conveying said contents onto said packing trap and into said envelope thereon through the open end thereof and for displacing said envelope and contents therein from said packing trap at the front end thereof when said packing trap is in said discharging position;

a hold down roller movably mounted adjacent said front end of said packing trap for movement between an envelope engaging position where said packing trap is in said envelope receiving position for guiding said envelope onto said front end of said packing trap, and a retracted position where said hold down roller is disengaged from said stripped envelope when said packing trap is in said discharging position; and means for operating said packing trap and hold down roller.

2. An enveloping device as claimed in claim 1 wherein:

said means for operating said packing trap and hold down roller comprises cam means and a lever mechanism operated by said cam means and operatively connected to said packing trap and said hold down roller.

3. An enveloping device as claimed in claim 1, wherein:

said plurality of first rotatable conveyor elements comprise a circular element on each side of said at least one flap opening element;

said circular elements and said at least one flap opening element are rotatable about a common axis of rotation;

first drive means is provided for rotating said at least one flap opening element; and second drive means is provided for rotating said circular elements.

4. An enveloping device as claimed in claim 2, wherein:

said plurality of first rotatable conveyor elements comprise a circular element on each side of said at least one flap opening element;

said circular elements and said at least one flap opening element are rotatable about a common axis of rotation;

first drive means is provided for rotating said at least one flap opening element; and second drive means is provided for rotating said circular elements.

5. The device as claimed in claim 3 and further comprising:

a first shaft mounted for rotation and operatively engaged with said second drive means for rotation thereby, said at least one flap opening element being rotatably mounted on said first shaft and said circular shaped elements being nonrotatably mounted on said first shaft.

6. The device as claimed in claim 4 and further comprising:

a first shaft mounted for rotation and operatively engaged with said second drive means for rotation thereby, said at least one flap opening element being rotatably mounted on said first shaft and said circular shaped elements being nonrotatably mounted on said first shaft.

7. The device as claimed in claim 3 wherein:

said at least one flap opening element comprises a plurality of circumferentially spaced claw shaped elements integrally mounted for rotation on a common circular path.

8. The device as claimed in claim 6 wherein:

said at least one flap opening element comprises:

a plurality of circumferentially spaced claw shaped elements integrally mounted for rotation on a common circular path.

9. The device as claimed in claim 3 wherein:

said plurality of first rotatable conveyor elements further comprise cooperating conveyor rollers having outer peripheral surfaces adjacent said part circular shaped elements for urging said flap against said part circular shaped elements when said flap is in the open position.

10. The device as claimed in claim 8 wherein:

said plurality of first rotatable conveyor elements further comprise cooperating conveyor rollers having outer peripheral surfaces adjacent with said part circular shaped elements for urging said flap against said part circular shaped elements when said flap is in the open position.

11. The device as claimed in claim 1 and further comprising:

a plurality of second rotatable conveyor rollers rotatably mounted between said first rotatable conveyor elements and said packing trap for engaging opposite sides of said envelope and conveying said envelope to said packing trap.

12. The device as claimed in claim 10 and further comprising:

a plurality of second rotatable conveyor rollers rotatably mounted between said first rotatable conveyor elements and said packing trap for engaging opposite sides of said envelope and conveying said envelope to said packing trap.

13. The device as claimed in claim 1 wherein:

said contents feeding conveyor comprises endless belt means disposed adjacent said contents support means and said packing trap, and finger elements mounted on said endless belt means and projecting outwardly therefrom for engagement with said contents for pushing said contents into said envelope and pushing said envelope and contents therein from said packing trap.

14. The device as claimed in claim 12 wherein:

said contents feeding conveyor comprises endless belt means disposed adjacent said contents support means and said packing trap, and finger elements mounted on said endless belt means and projecting outwardly therefrom for engagement with said contents for pushing said contents into said envelope and pushing said envelope and contents therein from said packing trap.

15. The device as claimed in claim 1 and further comprising:

envelope expanding elements projecting outwardly from said packing trap for engaging with and expanding at least the open end of said stripped envelope when said stripped envelope is mounted on said packing trap.

16. The device as claimed in claim 14 and further comprising:

envelope expanding elements projecting outwardly from said packing trap for engaging with and expanding at least the open end of said stripped envelope when said stripped envelope is at least partially received on said packing trap.

17. The device as claimed in claim 1, and further comprising:

discharge conveyor belt means disposed proximate the front end of said packing trap for receiving and conveying away from said packing trap said envelope and contents therein discharged from said packing trap.

18. The device as claimed in claim 16, and further comprising:

discharge conveyor belt means disposed proximate the front end of said packing trap for receiving and conveying away from said packing trap said envelope and contents therein discharged from said packing trap.

19. The device as claimed in claim 2 wherein said cam means and lever mechanism comprise:

a rotatably mounted cam having a cam surface thereon;

a first lever pivotally mounted adjacent said cam;

a cam follower rotatably mounted on said first lever and engaging said cam surface;

a second lever pivotally mounted proximate said packing trap;

a hold down roller engaging member projecting from said second lever and engaging said hold down roller for moving said hold down roller linearly between said envelope engaging position and said retracted position displaced from said engaging position;

a third lever pivotally mounted adjacent said packing trap and engaging said packing trap for pivoting said packing trap;

a first link member pivotally connected between said first lever and said second lever; and a second link member pivotally connected between said first lever and said third lever, so that rotation of said cam pivots said first lever to synchronously move said hold down roller and pivot said packing trap for simultaneous movement of said packing trap to said envelope receiving position and said hold down roller to said envelope engaging position and synchronously pivot said packing trap from said envelope receiving position to said discharging position and said hold down roller from said envelope engaging position to said retracted position.

20. A process for feeding and stuffing envelopes comprising:

supporting an upwardly extending stack of envelopes having first and second panels defining an open end, with a flap connected to said second panel on the open end of said envelopes folded under the bottoms of respective envelopes;

rotating a flap opening element around an axis and opening the flap on the bottom envelope of said stack by said flap opening element from the folded position underneath the bottom of said bottom envelope to a position extending outwardly from said open end of said envelope and in substantially the plane of said second panel;

engaging said outwardly extending flap by first rotating conveyor elements comprising means rotatable around said axis, and rotating said rotatable means around said axis for stripping said bottom envelope from said stack of envelopes and feeding said stripped envelope toward a pivotally mounted packing trap having a front end for receiving said stripped envelope;

pivoting said packing trap to an envelope receiving position for receiving at the front end thereof the open end of said envelope;

urging said stripped envelope against said front end of said packing trap in the receiving position thereof to guide said open end of said envelope onto said front end of said packing trap;

feeding said stripped envelope onto said packing trap while maintaining said second panel in the same orientation relative to said first panel and said stack and simultaneously opening at least the open end of said envelope by said packing trap in the receiving position;

pivoting said packing trap to a discharging position wherein said front of said packing trap is displaced from said receiving position;

supporting contents to be inserted in said envelope proximate the other end of said packing trap opposite said front end thereof;

inserting said contents through said open end of said envelope when said packing trap is in said discharging position;

pushing said envelope with said contents therein off of said packing trap from the front end thereof; and conveying said discharged envelope and contents therein away from said packing trap.

* * * * *